United States Patent [19]

Escott

[11] Patent Number: 4,887,818

[45] Date of Patent: Dec. 19, 1989

[54] AIRLINE OWNERSHIP AND TRAVEL GAME

[76] Inventor: Suzanne Escott, 6531 Gateridge Dr., Apt. 207, Raleigh, N.C. 27612

[21] Appl. No.: 142,442

[22] Filed: Jan. 11, 1988

[51] Int. Cl.[4] ..... A63F 3/04

[52] U.S. Cl. ..... 273/254; 273/251; 273/252; 273/256; 273/278

[58] Field of Search ..... 273/254, 256, 251, 252, 273/278

[56] References Cited

U.S. PATENT DOCUMENTS

| | | | |
|---|---|---|---|
| 2,026,082 | 12/1935 | Darrow | 273/254 |
| 3,467,387 | 9/1969 | Schmitt | 273/256 |
| 3,658,337 | 4/1972 | Peters et al. | 273/254 |
| 3,726,527 | 4/1973 | Schauffler | 273/254 |
| 4,109,917 | 8/1978 | Hatcher | 273/254 |
| 4,283,059 | 8/1981 | Beeder | 273/254 |
| 4,377,287 | 3/1983 | Erwin | 273/252 |

*Primary Examiner*—Edward M. Coven
*Assistant Examiner*—Jessica Harrison
*Attorney, Agent, or Firm*—Rhodes, Coats & Bennett

[57] ABSTRACT

The present invention entails a game, game board, and game apparatus that relates to world travel and airline ownership. Forming a part of the game is a game board having a world map formed thereon with a series of different airline routes extending across the map. The object of the game is to travel from one location to another and at the same time to purchase ownership of various airlines which produces income by other players utilizing that airline as they travel from one location to another.

6 Claims, 3 Drawing Sheets

AIRLINE OWNERSHIP AND TRAVEL GAME

FIELD OF INVENTION

The present invention relates to games and amusement devices and more particularly to an airline ownership and travel game.

SUMMARY AND OBJECTS OF THE INVENTION

Travel and enterprise is a favorite pastime and subject of many. Not everyone can travel to all the places that he or she desires. However, many people fantasize or dream about exotic and interesting places to visit. By the same token there are those people who have fantasized about owning their own airplane or even their own airline.

The present game entails a game and game board that is directed at fulfilling both desires or fantasies, that is the desire to travel as well as the desire to own one's own airline.

The game and game board apparatus of the present invention entails a world map that has a series of airline routes formed thereon. The respective airline routes represent a series of airlines.

It is the object of the game to travel from one location to another via certain airlines and over certain airline routes. During the course of travel a player may in fact purchase one or more airlines. A player may land on an airline route that represents an airline owned by another player. In that case, the player so landing will be indebted to the airline owner a certain amount.

Throughout the course of the game the respective players are traveling from one location to another location via these airline routes. The object of the game is to acquire as much money as possible and to bankrupt the other players through acquiring airlines.

It is therefore an object of the present invention to provide a game and game board that is designed to emphasize travel and enterprise.

Another object of the present invention entails a game and game board wherein the individual players travel between locations throughout the world along designated air routes.

Still a further object of the present invention entails the provision of a game and game board apparatus wherein the respective players may acquire certain airlines as they travel from one location to another.

Still a further object of the present invention resides in the provision of a game and a game board apparatus wherein a player is required to pay a certain amount of money to another player that owns an airline when he or she lands on a space or airline route that is owned by the other player.

Still a further object of the present invention entails the provision of a game and game bard apparatus of the character referred to above that is exciting and interesting.

Another object of the present invention entails the provision of a game that emphasizes geography and enables players, especially young children, to learn geography from playing the game.

Other objects and advantages of the present invention will become apparent and obvious from a study of the following description and the accompanying drawings which are merely illustrative of such invention.

DETAILED DESCRIPTION OF THE INVENTION

Figure 1:
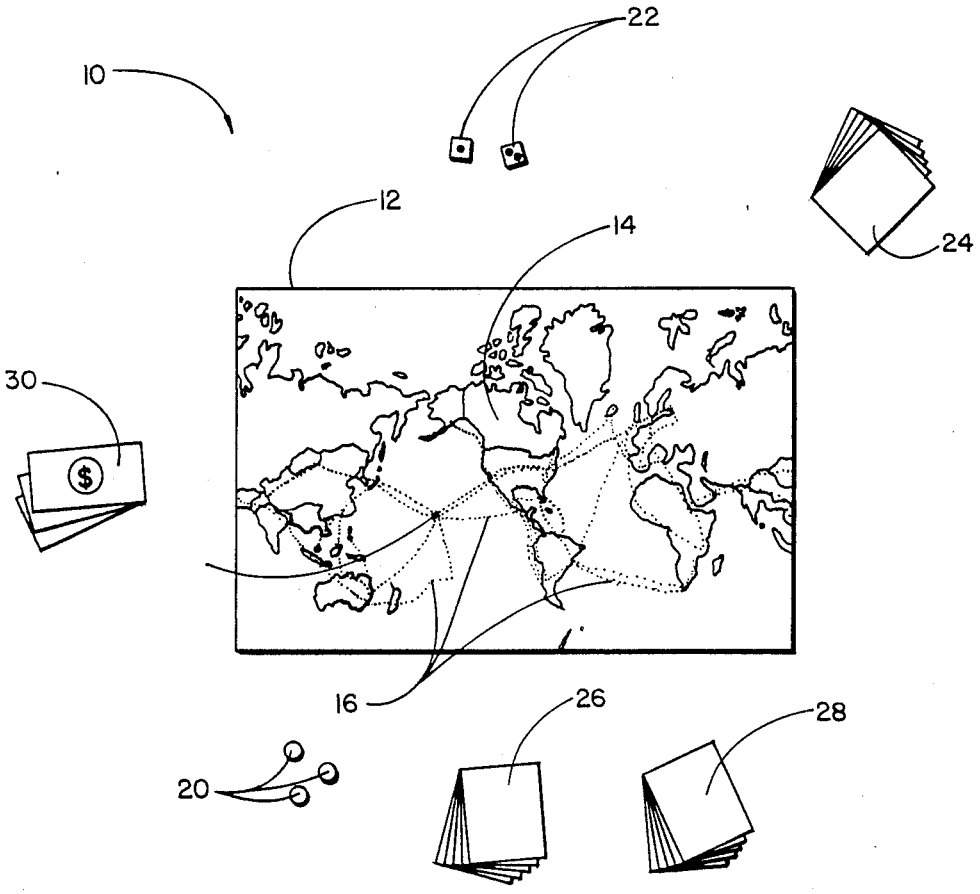
FIG. 1 is a top plan view of the game and game board apparatus of the present invention.
Figure 2:
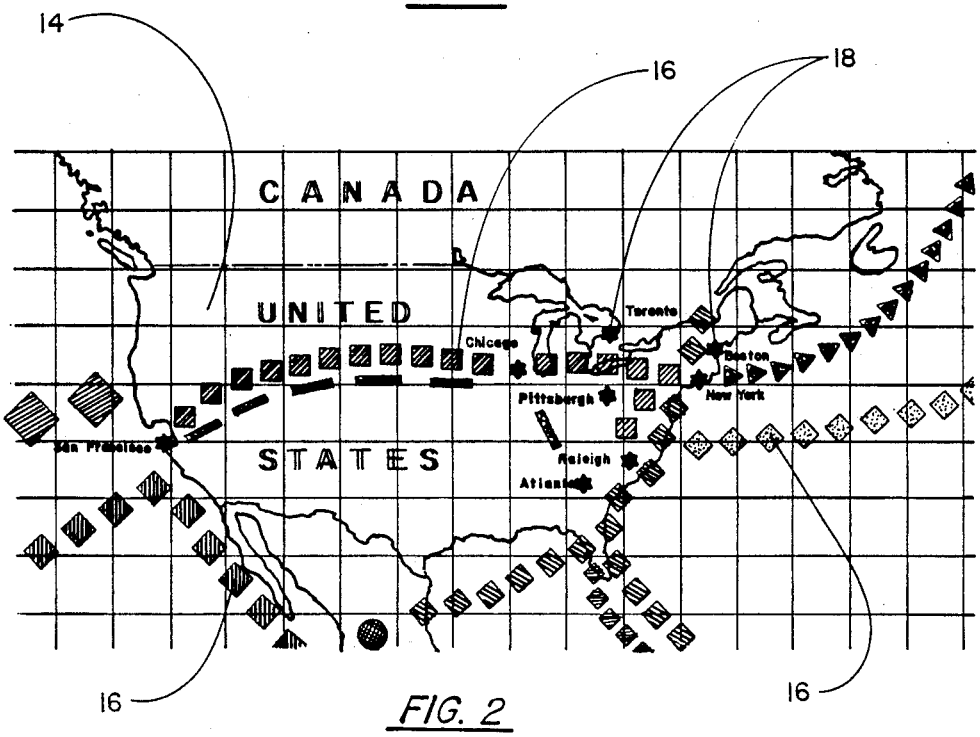
FIG. 2 is a fragmentary plan view of a portion of the game board illustrating a series of airline routes across the United States.
Figure 3:
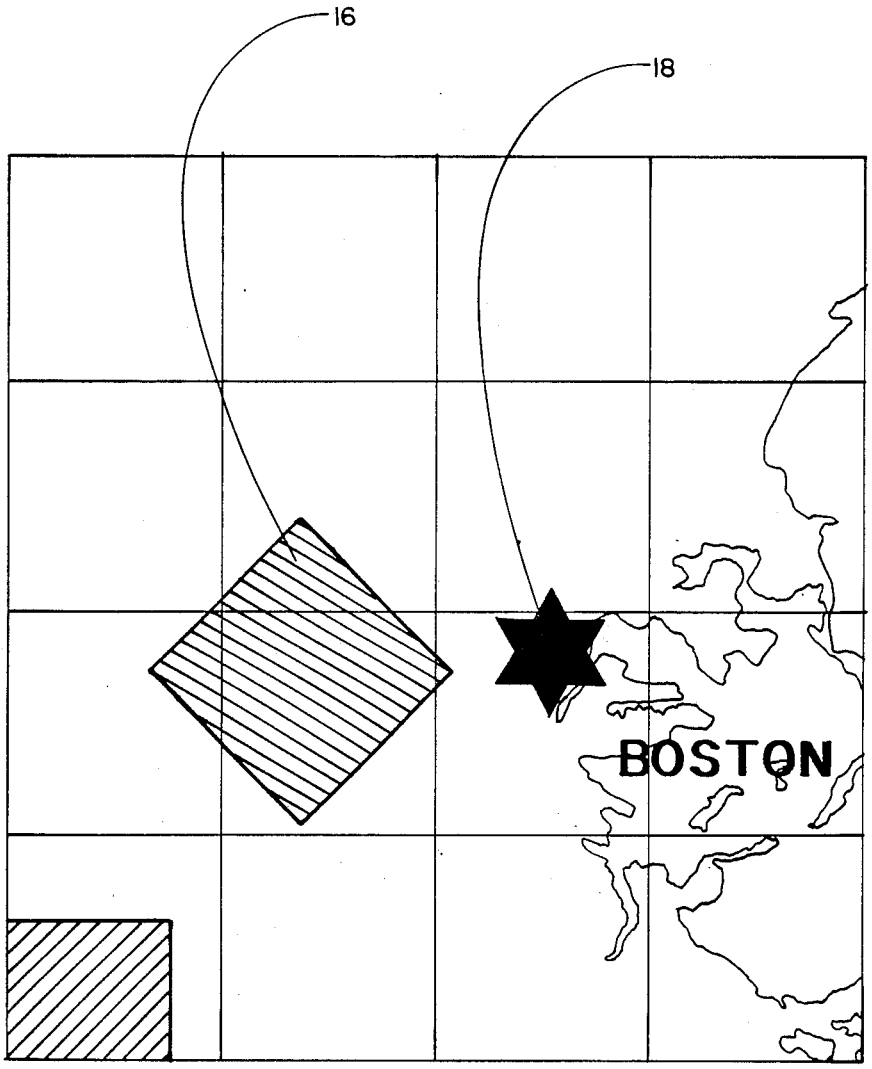
FIG. 3 is an enlarged fragmentary section of the game board showing the location of an airport and an airline route leading thereto.

With further reference to the drawings, the airline ownership and travel game of the present invention is shown therein and indicated generally by the numeral 10. Viewing game and game apparatus 10 in more detail, it is seen that the same includes a game board 12. Formed on the game board 12 is a world map 14 that as seen in the drawings includes a substantial number of countries.

Extending across game board 12 and across world map 14 is a series of different airline routes 16. Airline routes 16 extend from country to country and from city to city. The respective airline routes 16 merge or lead to certain airports, indicated by the numeral 18, spaced over the world.

As can be seen from the drawings, there are a series of different airline routes 16 and these routes represent different airlines. Note that the differing routes are designated by different geographical symbols such as squares, triangles, etc., and/or by different shadings or markings within the geometric symbols.

It is further seen that each airline route is segmented and includes a series of spaced apart increments. The respective increments effectively measure the distance between airports and as will be more fully understood from subsequent portions of this disclosure, during the course of a game a player will move his or her token along the spaced apart increments.

The game and game apparatus 10 further includes a series of travel tokens 20 that are used by the respective players during the course of playing this game. Travel tokens 20 are moved along a particular airline route. To determine the extent that a player's token is advanced during the play of the game, there is provided die means 22. In the course of playing the game, as will be more fully understood after a complete reading of this disclosure, a player will advance his or her token 20 a number of increments along the map corresponding to the number rolled on the die means 22.

Figure 4:
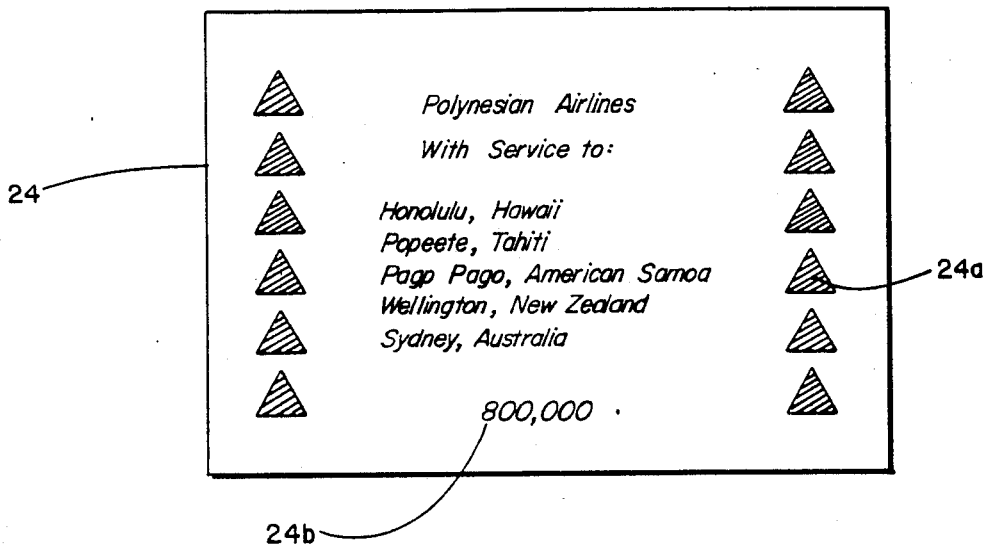
FIG. 4 is a plan view of an airline title card that forms a part of the present game.

Also, provided as a part of the game and game apparatus 10 is a series of airline title cards indicated by the numeral 24. For each airline represented on the game board 12 there is provided one airline title card 24. A respective airline title card 24 includes a symbol or series of symbols **24*a* that match the symbol of that particular airline as illustrated on the airline route 16. In addition, because the present game involves the purchase of airlines, the purchase price for that particular airline is shown at 24*b* on the particular airline title card 24. An example of an airline title card 24 is shown in FIG. 4** and it is seen that in a preferred embodiment that the card includes a list of the cities or locations that the airline serves.

It is appreciated that the names and number of airlines may vary. But in the interest of a complete disclosure, the following is a list of airlines along with a suggested purchase price:

| NAME OF AIRLINE | PURCHASE PRICE |
|---|---|
| Moroccan Airlines | $500,000 |
| Sun Airlines | $1,000,000 |
| Swedish Airlines | $1,000,000 |
| Caribbean Airlines | $800,000 |
| Philippine Airlines | $700,000 |
| North African Airlines | $5,000,000 |
| Polynesian Airlines | $800,000 |
| North Sea Airlines | $200,000 |
| The Continent Airlines | $200,000 |
| Tokyo Airlines | $2,000,000 |
| South Africa Airlines | $800,000 |
| Gulf Airlines | $1,000,000 |
| Burma Airlines | $1,000,000 |
| Pacific Airlines | $500,000 |
| Mainland Airlines | $200,000 |
| Cherokee Airlines | $500,000 |
| Washington Airlines | $500,000 |
| The World Airlines | $3,000,000 |
| North Atlantic Airlines | $500,000 |
| Gorky Airlines | $100,000 |

In addition, provided with the game and game apparatus 10 of the present invention there is provided a deck of destination cards 26. The deck of destination cards 26 includes a series of cards with each card having the name of a city, location or certain geographical area. As will be more fully understood, these designation cards 26 indicate to the player both the point of departure and the destination that he or she will seek during the course of playing a game. Although the location set forth on the destination cards 26 can vary, the following is a list of preferred cities that are found in the game of the present disclosure:

| LOCATIONS FOUND ON DESTINATION CARDS | |
|---|---|
| Mexico City, Mexico | Los Angeles, California |
| Pago Pagp, American Samoa | Sydney, Australia |
| Honolulu, Hawaii | New York City, New York |
| Olympia, Washington | Paris, France |
| Tokyo, Japan | Cape Town, South Africa |
| Boston, Massachusetts | Hong Kong, China |
| Santiago, Chile | Rio de Janerio, Brazil |
| Honolulu, Hawaii | Cape Town, South Africa |
| Logos, Nigeria Africa | Manila, Philippines |
| Pretoria, Africa | Nairobi, Kenya, Africa |
| Cairo, Egypt | Bonn, West Germany |
| Berlin, East Germany | Ulaanboator, Mongolia |
| Hanoi, Vietnam | Wellington, New Zealand |
| Kabule, Afghanistan | Tehran, Iran |
| Calcutta, India | New Delhi, India |
| Rome, Italy | Anchorage, Alaska |
| Port Moresby, New Guinea | Casablanca, Morocco |
| Reykjavik, Iceland | Toronto, Canada |
| Pittsburgh, Pennsylvania | Helsinki, Finland |
| San Francisco, California | Stockholm, Sweden |
| Oslow, Norway | Warsaw, Poland |
| Gorky, Russia | Moscow, Russia |
| Lisbon, Portugal | Havanna, Cuba |
| Caracas, Venezuela | Lima, Peru |
| Bankok, Thailand | Rangoon, Burma |
| San Juan, Puerto Rico | Atlanta, Georgia |
| Raleigh, North Carolina | Popeete, Tahiti |
| Singapore, Malaysia | Madrid, Spain |
| Guatamala City, Guatamala | Miami, Florida |
| Mexico City, Mexico | Chicago, Illinois |
| Managua, Nicaragua | Juneau, Alaska |

-continued

| LOCATIONS FOUND ON DESTINATION CARDS |
|---|
| London, England |

In addition, the game and game apparatus 10 of the present invention includes a deck of chance or consquence cards 28. The chance cards 28 generally include a reward or a penalty or some other type of consequence. In the present game the player is required to draw a chance card each time he or she reaches a certain destination.

As with the destination cards, the chance cards can vary depending upon desired effects. In the interest of providing a complete disclosure, the following is a list of consequences found on various chance cards 28 provided with this game.

CHANCE CARDS

You receive $50,000 from the sale of stock.

You make a donation of $5,000 to the local animal shelter.

You help sponsor a pro golf tournament. Your cost after proceeds and expenses is $20,000.

You purchase a vacation home. Pay the bank $150,000.

You assist the U.S. government with a special project.

You must go immediately to Moscow, Russia. Collect $50,000 from the bank.

You receive oil royalties of $20,000.

You loan a close relative $10,000.

You receive your monthly oil royalties of $20,000.

You make a donation of $5,000 to a local charity.

You inherit $100,000.

Pay the bank $25,000 for your home remodeling expenses.

A new wardrobe cost you $3,000.

Fly to London, England for a business meeting. Withdraw $5,000.

You inherit $200,000.

You find just the right oil painting for your office at a cost of only $30,000.

Your plane has been hijacked to Havanna, Cuba.

You throw a party for your friends at the Country Club. Expenses total $10,000.

You receive $20,000 from the sale of stock.

Pay your tax accountant $5,000.

Pay the bank $40,000 for your new Mercedes.

Pay each player $5,000.

Go to Cape Town, South Africa.

Take the Seagull Express to your next destination. (You may hold this card for use later.)

Take a vacation in Honolulu, Hawaii. Take $20,000 from your bank account.

Pay each player $5,000.

You need to meet with your lawyer in New York City. Withdraw $5,000 from you bank account for expenses.

Take the Seagull Express to your next destination. (You may hold this card for use later.)

You inherit $500,000 from a rich uncle.

Your dream of sailing the South China Sea has come true. Fly directly to Manila, Philippines to meet with your ship.

Fly to Puerto Rico for a week's vacation.

Finally, the game includes a bank of simulated money 30.

To play the present game, a person is chosen as the "banker" and each player will be given an initial capital amount as follows:

4 - $5,000
4 - $20,000
5 - $50,000
3 - $100,000
1 - $500,000
4 - $1,000,000

During the course of the game, the chosen "banker" will handle all transactions and as such will be the custodian for the airline title cards 24, will handle mortgages in case of financial difficulties of respective players, and will disburse money from the bank in accordance with the rules of the present game.

Airline title cards 24 will be kept in a location that will enable all the players to determine available airline properties and their respective prices.

In order to start the game, each player rolls the dice 22 and the player rolling the highest number will be the first to start the game.

Before any player can begin he or she must draw two cards from the destination deck 26. The first card will indicate the departure location for that player. The second card from the destination deck 26 will indicate the player's destination. The player should hold his destination card and maintain the location of his destination secret. This is because an object of the game is to acquire airline properties that will produce income from other players. Thus, the purchase of airline properties may be influenced by knowing the destination of other players.

The player beginning the game will place his or her travel token 20 on the point of departure. He or she then rolls the dice 22 and begins heading towards his or destination. It is appreciated that the airline routes 16 are broken up into incremental parts. A player is allowed to advance his or her travel token 20 a certain number of increments along a chosen airline route 16 that corresponds to the number rolled by the die means 22.

Travel is free along any airline route as long as the airline is not owned by another player. Any time a player lands on an airline route increment that is owned by another player the player so landing must pay the owner $5,000 each time.

As a player moves towards his or her destination, that player can change airlines only at airports 18.

During the course of playing the game and advancing towards a destination, a player can purchase an airline for the purchase price shown on the airline title card 24, so long as that airline has not been previously purchased. A player can only purchase one airline per turn, that purchase being preferably made prior to his or her roll of the dice 22.

A player may mortage an airline that he or she owns. The maximum amount a player may receive through a mortgage is 75% of the purchase price **24*b* shown on the title card 24**. For purposes of order and understanding it is suggested that any airline that has been mortgaged should be represented by the owner turning the airline title card face down where all players can determine that such has taken place.

To interject excitement and interest, the game has the provision that a player may offer a takeover bid on any airline that is owned by another player. To control the takeover bid, the bid cannot be more than twice the purchase price as set forth on the airline title card 24. In the case of a takeover bid, the present owner of the airline being subjected to the takeover attempt has three turns to match the amount of the takeover bid. Also while the owner is attempting to match the takeover bid, the player making the offer must set the bid amount aside until it can be determined if the takeover will in fact occur. If the takeover does occur, the player who will become the new owner will pay the bid amount to the previous owner. It should be understood that more than one player may offer a takeover bid of the same airline at the same time.

If any player rolls doubles, he or she may continue to roll.

Upon reaching one's destination, the bank pays a player the sum of $50,000 and thereafter that player has to draw a chance card from the chance card deck. After abiding by the dictates of the chance card, that player will then draw another destination card 26 from the top of the destination card stack. The previous destination card will be placed on the bottom of the same deck. The player will then continue to travel towards the new destination when his or her turn arrives.

The object of the game is to control the finances of all the other players and to effectively bankrupt them during the process. Therefore, the one player remaining in the game that still has financial resources is declared the winner.

From the foregoing specification and discussion it is seen that the present game presents a very exciting and interesting game that combines enterprise with travel. The present game is particularly suited for children of all ages as well as adults and in fact is a game that can be played among both children and adults. Not only is it fun and interesting but the game is educational as it gives geography insights especially to younger children.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An airline ownership and travel game comprising:

(a) a game board including a world map that shows a substantial number of countries throughout the world;

(b) a series of different airline routes formed across the world map and extending between selected locations in various depicted countries;

(c) each airline route including a segmented travel path formed on the game board with the segmented travel path for each airline including a series of incremented travel spaces;

(d) a series of airlines entities depicted on the game board along the series of different airline routes such that a number of different airline entity routes extend across the world map;

(e) a plurality of player travel tokens for movement along respective airline travel paths during the course of the game;

(f) die means for establishing movement value for the travel tokens such that for any value rolled on the die means, the player rolling such will advance his or her travel token a corresponding number of increments along a selected route;

(g) a deck of destination cards forming a part of the game with respective destination cards including the identification of locations that correspond to airports formed along the respective airline routes;

(h) a deck of chance cards forming a part of the game with the deck of chance cards including both reward and penalty cards and wherein respective players draw from the chance card deck as a consequence of arriving at selected locations along respective airline routes;

(i) a series of airline title cards forming a part of the game with respective title cards representing the title to a particular airline having an airline route passing over the game board, each airline title card having a purchase price inscribed thereon for that particular airline; and (j) simulated money forming a part of the game and wherein respective players utilize the simulated money to purchase airlines that have routes passing over the game board and wherein respective players are penalized monetarily for landing on an airline route owned by another player.

2. The airline ownership and travel game of claim 1 wherein the destination card deck establishes both a departure location and a destination location for players during the course of playing the present game.

3. The airline ownership and travel game of claim 1 wherein the respective airline routes are formed by laterally spaced geometric symbols that define a path for each airline, and wherein each airline is represented by a particular geometric symbol.

4. The airline ownership and travel game of claim 1 wherein a series of respective airline routes converge at numerous locations on the game board and wherein at the point of each convergence there is located an airport.

5. An airline ownership, game board and game apparatus for playing the same comprising: a game board having a substantial portion of a world map formed thereon that depicts a plurality of countries; a series of different airline routes formed on the game board and stretching between selected locations on the map; the airline routes defining a plurality of airline entities which serve respective routes; each airline route including a segmented travel path representing a particular airline entity and formed by a series of spaced apart increments; a series of travel tokens forming a part of the game apparatus of the present invention that are moved by respective players along the space increments of a selected route; a deck of destination cards forming a part of the game apparatus with respective cards of the deck defining a selected location along the defined airline routes formed on the map and game board; a group of airline title cards forming a part of the game and game board apparatus with each airline title card identifying a particular airline whose route appears on the game board and the purchase price for that particular airline, and wherein individual players may choose to purchase a selected airline whose route that players token lands on during the course of the game; and simulated money forming a part of the game and game apparatus for allowing players to make financial transactions relating to the game while the game is being played.

6. The airline ownership game of claim 5 wherein the game and game apparatus further comprises a deck of chance cards with the deck of chance cards including both reward and penalty cards and wherein certain portions of selected airline routes are designated such that a player is required to draw a chance card upon reaching that designated area.

* * * * *

UNITED STATES PATENT AND TRADEMARK OFFICE

CERTIFICATE OF CORRECTION

PATENT NO. : 4,887,818

DATED : December 19, 1989

INVENTOR(S) : Suzanne Escott

It is certified that error appears in the above-identified patent and that said Letters Patent is hereby corrected as shown below:

On the title page:

Address as printed on patent: Suzanne Escott
6531 Gateridge Drive
Apt. 207
Raleigh, NC 27612

Address should be: Suzanne Escott
509 Elm Street
Martins Ferry, OH 43935

Signed and Sealed this

Twenty-sixth Day of February, 1991

*Attest:*

HARRY F. MANBECK, JR.

*Attesting Officer*

*Commissioner of Patents and Trademarks*